United States Patent [19]

Komatsubara et al.

[11] Patent Number: 4,682,881

[45] Date of Patent: Jul. 28, 1987

[54] APPARATUS FOR PRODUCING AN ELECTROPHOTOGRAPHIC PRINT

[75] Inventors: Shoji Komatsubara; Yukio Hatabe; Tooru Horikawa, all of Shigaken; Sadao Murasawa, Hyogoken; Hajime Murakami, Shigaken, all of Japan

[73] Assignees: Dainippon Screen Mfg. Co., Ltd., Kyoto; Ishihara Sangyo Kaisha Ltd., Osakafu, both of Japan

[21] Appl. No.: 794,185

[22] Filed: Nov. 1, 1985

[30] Foreign Application Priority Data

Nov. 22, 1984 [JP] Japan ..... 59-247672

[51] Int. Cl.[4] ..... G03G 15/10

[52] U.S. Cl. ..... 355/10; 354/317; 355/15

[58] Field of Search ..... 355/3 R, 10, 15; 118/659, 660; 354/317

[56] References Cited

U.S. PATENT DOCUMENTS

| | | | |
|---|---|---|---|
| 1,928,235 | 9/1933 | Taylor | 354/317 X |
| 3,618,567 | 11/1971 | Levy | 118/660 X |
| 3,741,093 | 6/1973 | Komori et al. | 355/10 X |
| 4,110,029 | 8/1978 | Goshima et al. | 355/10 |
| 4,208,121 | 6/1980 | Muller | 355/10 |
| 4,270,859 | 6/1981 | Galbraith et al. | 355/10 |
| 4,358,195 | 11/1982 | Kuehnle et al. | 355/10 X |

*Primary Examiner*—Fred L. Braun

*Attorney, Agent, or Firm*—Brumbaugh, Graves, Donohue & Raymond

[57] ABSTRACT

An apparatus for producing an electrophotographic print on a photosensitive receptor which is movable through a plurality of predetermined stations so as to produce an electrostatic latent image on the photosensitive receptor, the apparatus including a rotary drum having a peripheral surface which defines an image forming section and a non-image forming section, the photosensitive sheet being placeable on the image forming section of the drum surface, a developing unit having at least one developing section for supplying a developer to the photosensitive sheet on the drum, thereby making the electrostatic latent image visible, and a device for collecting the used developer from the photosensitive sheet, the collecting device being provided axially of the drum in the non-image forming section of the peripheral surface.

9 Claims, 5 Drawing Figures

APPARATUS FOR PRODUCING AN ELECTROPHOTOGRAPHIC PRINT

BACKGROUND OF THE INVENTION

1. Field of the Invention

The present invention relates generally to an apparatus for producing an electrophotographic print on a photosensitive material, and more particularly, a wet-type electrophotographic copying machine including an improvement on the treatment of the used developer remaining on the photosensitive sheet.

2. Description of the Prior Art

In a wet-type electrophotographic copying machine, hereinafter referred to merely as the copying machine, it is necessary to remove the used developer remaining on the photosensitive sheet. To this end there have been many proposals, among which are methods disclosed in Japanese Patent Publications (examined) No. 51 (1976)-15747, and No. 58 (1983)-47707. Both of them teach the employment of a special roller kept in contact with the photosensitive sheet, thereby collecting the used developer, and returning it into the reservoir.

However, the developer is collected in the reservoir after it has flowed along the surfaces of the photosensitive sheet. In the course of flowing on the surfaces of the photosensitive sheet, the toner is consumed in conducting the expected development, and the developer as a whole is diluted. In addition, the developer unavoidably becomes contaminated by other substances which are mixed in. If the diluted, polluted, used developer enters the reservoir, the developer therein will be diluted and polluted. This deteriorates the developing ability, and shortens the life of the developer.

To compensate for the diluted developer, it becomes necessary to constantly give a fresh supply of developer. Particularly, in a multi-color copying machine it often happens that a developer for one color gets mixed with one for another color. This is fatal to color copying.

OBJECTS AND SUMMARY OF THE INVENTION

The present invention is directed to solve the problems pointed out above, and has for its object to provide a copying machine in which the used developer is removed before entering the reservoir, thereby keeping the developer therein constantly fresh.

Other objects and advantages of the present invention will become more apparent from the following description when taken in conjunction with the accompanying drawings which show, for the purpose of illustration only, one embodiment in accordance with the present invention.

Pursuant to this object, one aspect of the invention resides in a wet-type electrophotographic copying machine having a rotary drum for allowing a photosensitive sheet to be placed thereon. In addition, a developing unit having at least one developing section is provided for supplying a developer to the photosensitive sheet on the drum to make the electrostatic latent image visible. The invention also includes means for collecting the used developer from the photosensitive sheet, the means being provided in an area where no electrostatic latent image is produced, and the means being produced crosswise of the drum.

DETAILED DESCRIPTION OF THE PREFERRED EMBODIMENT

Figure 1:
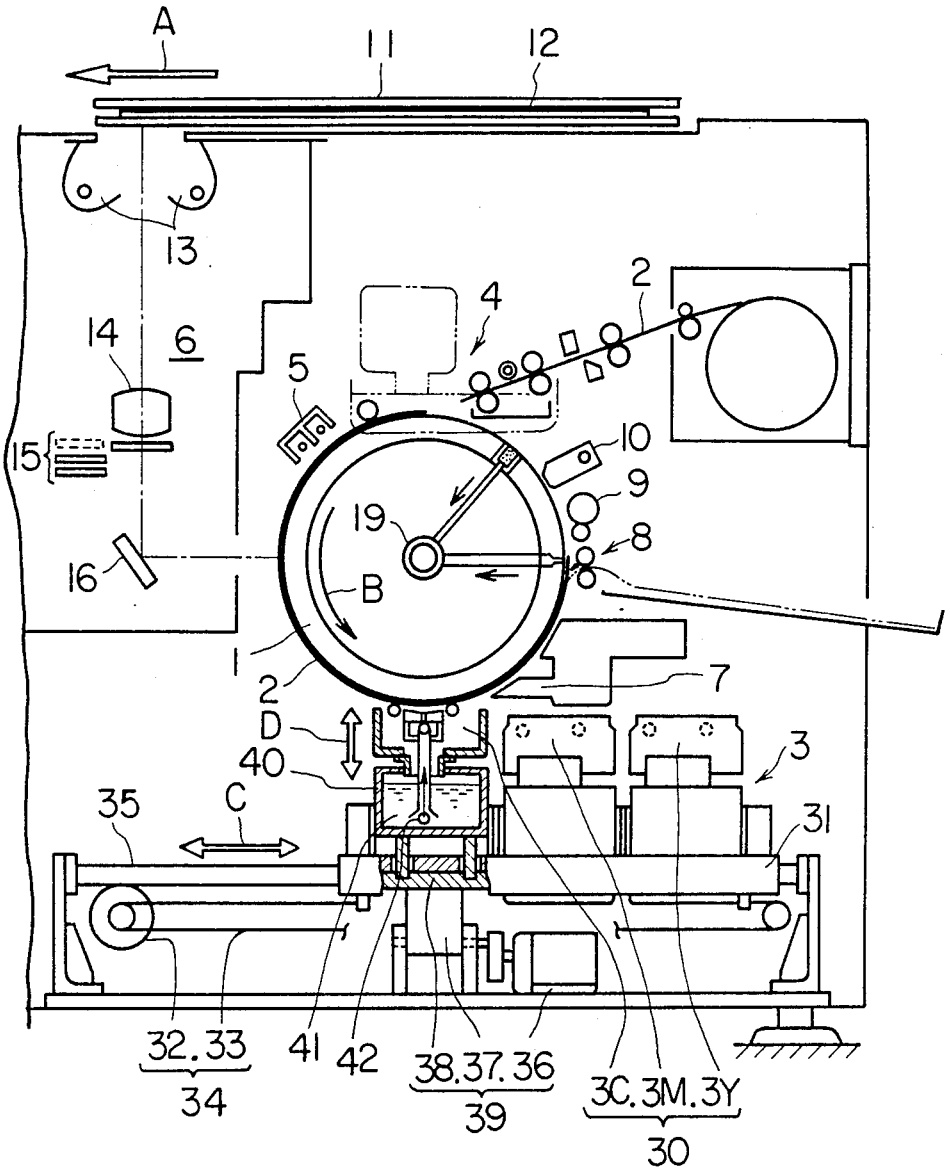
FIG. 1 is a cross-section through a wet-type electrophotographic copying machine embodying the present invention.

Referring to FIG. 1, there is provided a rotary drum 1 on which a photosensitive or merely sensitive sheet 2 is placed. The reference numeral 3 denotes a wet-type developing unit located under the drum 1, whereby the electrostatic latent image in the sensitive sheet 2 is registered and realized. The developing unit 3 includes a number of developing sections corresponding to the number of colors. The reference numeral 4 denotes a device whereby the sensitive sheet 2 is smoothly placed on the drum 1, hereinafter referred to as the sheet winding device. The sheet 2 passes under a charger 5 which gives an electrostatic charge to the sheet 2. The reference numeral 6 denotes an optical system, which includes an original carrier 11 carrying an original 12, a light 13, a lens 14, color separating filters 15, and a mirror 16. The reference numerals 7, 8, 9 and 10 denote a pneumatic knife, a sheet releasing device, a drum cleaning device, and a deelectrifier, respectively, which are located along the periphery of the drum 1.

The original carrier 11 is reciprocally moved in a fixed range. When it is moved in the direction of arrow (A) the optical image is obtained from the running original 12, and is subjected to color separation by the filter 15. Then the image is projected on the sensitive sheet 2, thus producing the electrostatic latent image.

As mentioned above, the developing unit 3 includes a developing section 30; in the illustrated embodiment the section has three divisions 3C, 3M and 3Y, which denote a cyan section, a magenta section and a yellow section, respectively. Where required, a black section (not shown) is added. On the sensitive sheet 2 a latent image for one color is produced, and registered by development with toner of the color. Then another latent image for another color is developed with toner of that color. This is repeated until the image is registered in the desired number of colors.

The developing sections 3C, 3M and 3Y are mounted on a carrier 31, which moves to and fro in the direction of arrow (C). These sections are movable up and down in the direction of arrow (D) independently of one another. The carrier 31 is moved by means of a guide bar 35, which is moved by a driving unit 34 including a motor 32 and a chain 33. In the course of moving to and fro, the carrier 31 is stopped at a desired position under the drum 1, and then the developing section is raised by means of an ascending unit 39, which includes a motor 36, a crank 37 and a rising plate 38, thereby enabling the respective developing section 30 to be situated close to the sensitive sheet 2 on the drum 1. Under this arrangement each developing section 30 comes near to the drum 1 so that the developer 41 is effectively applied to the sensitive sheet 2 from a reservoir 40 by means of a pump 42.

Figure 2:
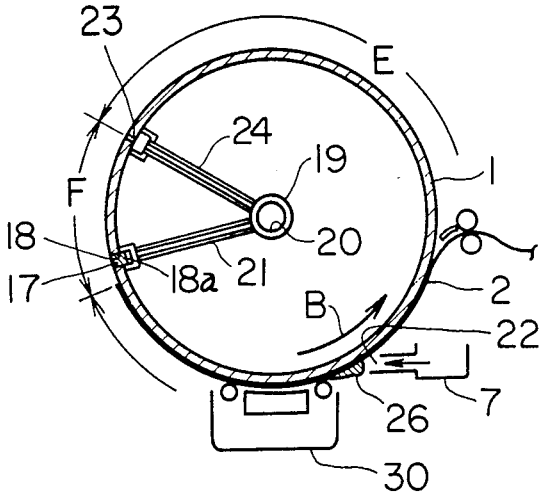
FIG. 2 is a cross-section on an enlarged scale of the drum shown in FIG. 1, when the development is in operation.
Figure 3:
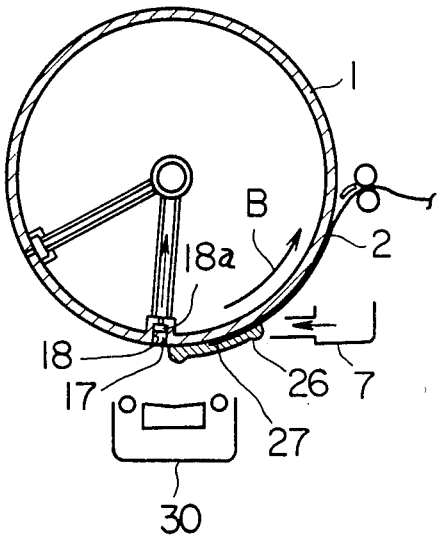
FIG. 3 is a cross-section on an enlarged scale of the drum of FIG. 2 when the development is out of operation.

As shown in FIG. 2, the surface of the drum 1 is divided into two sections; that is, an image forming section (E) on which the sensitive sheet 2 is placed, and, a non-image forming section (F) on which no sheet is placed but a developer collecting means 18 is provided. In the illustrated embodiment the developer collecting means is a ditch or groove produced crosswise to the drum surface. The groove is to absorb the used developer therein by suction.

The groove 18 is communicated with a suction duct 20 provided in a rotary shaft 19 of the drum 1 through a connecting pipe 21. The used developer is drawn into the groove 18 by suction provided by a blower (not shown) through the suction duct 20. The groove 18 is provided with an absorbent material 17, such as felt or sponge. Preferably a drain (not shown) is provided between the suction duct 20 and the blower. The absorbent material 17 is placed in such a manner so as to produce a space 18*a* at the bottom of the groove 18. The space 18*a* is to diffuse the sucking force extensively within the groove through the connecting pipe 21. If no space 18*a* is present, the sucking force will be likely to concentrate on the part at which the connecting pipe 21 is connected to the groove 18.

The function of the absorbent material 17 will next be described in detail.

If the groove 18 has no absorbent material, some portion of the developer which is sucked into the groove 18 will stick in dewdrops to both side walls of the groove 18 due to the mutual interfacial tension. The dewdrops are likely to block the opening of the groove 18 from one part to another part thereof. Once the dewdrops have been brought about, the suction will exert exclusively on the part of the groove 18 which is free from the dewdrops, thereby reducing the efficiency of suction. In addition, the suction tends to lose its continuity or becomes intermittent. The absorbent material 17 placed in the groove 18 is effectively resistant to the flow of air and the developer being sucked therein, thereby distributing the suction evenly, whether the absorbent material 17 is impregnated with the used developer or not.

The pneumatic knife 7 includes an air outlet 22 projecting against the rotating direction of the drum 1, thereby causing the developer on the sensitive sheet 2 to fall in drops downstream of the rotating direction of the drum 1 under the pneumatic force.

The diameter of the drum 1 is so determined that its circumferencial length is longer than the image of the largest size obtainable by the machine. The image forming section (E) is made equal in length to the image of the largest size, and the groove 18 is produced in the sheetfree section (F).

Figure 4:
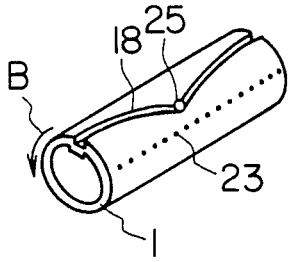
FIG. 4 is a perspective view showing the drum shown in FIG. 1.

As shown in FIGS. 2 and 4 the image forming section (E) is provided with sucking holes 23 produced crosswise to the drum surface, thereby ensuring that the sensitive sheet 2 adheres to the drum surface by suction. The sucking holes 23 are connected to the sucking duct 20 through a connecting pipe 24.

The groove 18 is shaped so as to be equal to the width of the sensitive sheet 2 placed on the drum 1. However, the groove 18 need not be straight across the drum surface. As shown in FIG. 4 the groove 18 can be curved against the rotating direction (B) of the drum 1. In the illustrated embodiment two groove portions gather at a drain hole 25, through which the sucked developer is led to the connecting pipe 21.

In operation, the developing section 30 for the required color is raised by the ascending unit 39 until it comes so near to the sensitive sheet 2 that the developer can be effectively transferred thereto. The developer sticks to the sheet surface, but because of the pneumatic force provided by the pneumatic knife 7 it is prevented from following the moving sheet surface. The reference numeral 26 denotes an accumulating developer which is left from the moving sheet surface. When the terminating end of the sensitive sheet 2 reaches the developing section 30, the developing section 30 is lowered by the ascending unit 39, and the supply of the developer is suspended. At this stage the groove 18 comes so near to the accumulating developer 26 that it is absorbed in the absorbent material 17 in the groove 18, thereby allowing the developer to discharge out of the machine.

Preferably the drum 1 is rotated by means of a pulse motor driven in response to signals bearing information about the starting end and terminating end of the image forming section (E). This is known in the art, and a detailed description will be omitted.

The present invention is not limited to the embodiment illustrated above, but can be applied to a copying machine which has a single developing section, that is, a monochrome copying machine. The copying system referred to above is the CPC (coated paper copier) system, under which the image is directly registered on a sensitive sheet. However the present invention can be also applied to the PPC system (plain paper copier) under which a sensitive zone is produced on the drum surface, and a toner image is transferred to a plain paper.

Figure 5:
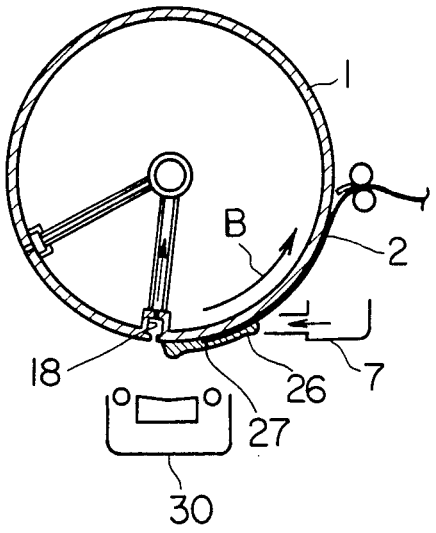
FIG. 5 is a cross-section through a drum having a modified groove.

The used developer is drained out of the machine under the illustrated arrangement, but the drainage means is not limited to it. For example the absorbent material can be fully packed in the groove. Alternatively, it is possible to use no absorbent material with the risk of reduced efficiency. The shape of the groove can vary; FIG. 5 shows a groove opening divergently toward the depth. Instead of the groove a number of pores can be produced crosswise of the width of the drum, wherein the interval between the adjacent pores is preferably minimized.

For the absorbent material 17, felt, sponge, cloth or the like can be selectively used. It is desired that the absorbent material does not extrude from the drum surface. To this end it is preferred that the groove is provided with a recess at its opening for accommodating the absorbent material completely embedded therein.

When the absorbent material is saturated with the developer absorbed therein, it is required to dry it. For this purpose one practice is to eject hot air against the saturated absorbent material so as to allow the absorbed developer to vaporize. Another practice is to suck the absorbed developer by means of a sucking device provided outside the drum 1, wherein the sucking member is intermittently kept in contact with the absorbent material. Alternatively, the absorbent material can be provided in such a manner so as to cover the suction opening provided on the drum surface, and lead the developer out of the drum therethrough.

When the amount of developer to be removed is small, the groove can have no absorbent material. In this case there will be a fear of the developer dropping through the groove when the drum is rotated. In fact, however, the developer sticks to the inside walls of the groove, and will not fall in drops.

As the photosensitive sheet the following may be used in the present invention: a backing of relatively electrically conductive material sheet such as paper or plastic film coated with an electroconductive material, or a metal plate having a coating of electrophotoconductive material layer such as titanium dioxide, zinc oxide, and the like, dispersed in a resinous binder on one surface thereof to provide the electrophotoconductive surface. It is especially advantageous to use a photosensitive sheet containing titanium dioxide, this results in a multicolor print image having high contrast with good gradation of the image.

As evident from the foregoing description, the present invention has the following advantages:

(1) The used developer remaining on the sensitive sheet is effectively removed without returning to the reservoir, thereby keeping the surface of the sensitive sheet free from the used developer.

(2) The removal of the used developer ensures that the developer stored in the reservoir is protected against dilution and contamination, thereby securing a prolonged life of the developer, and an effective concentration of the toner content.

(3) In multicolor copying machines the developer stored in the reservoir is protected against possible contamination with another color, thereby keeping the developer stored in the reservoir constantly pure. On the sensitive sheet the used developers of different colors are prevented from getting mixed with each other, thereby securing a clear reproduction of color image.

While the invention has been illustrated and described as embodied in a wet-type electrophotographic copying machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An apparatus for producing an electrophotographic print on a photosensitive receptor movable through a plurality of predetermined stations so as to produce an electrostatic latent image on the photosensitive receptor, the apparatus comprising: a rotary drum having a peripheral surface defining an image forming section and a non-image forming section, the photosensitive receptor being placeable on the image forming section of the drum surface; a developing unit having at least one developing station for supplying a developer to the photosensitive receptor on the drum so as to make the electrostatic latent image visible; means for collecting the used developer from the photosensitive receptor, the collecting means being provided axially of the drum in the non-image forming section of the peripheral surface and including a suction opening on the drum surface connected to a sucking means provided externally of the drum, the suction opening being formed as a groove extending crosswise of the drum surface; and a developer absorbent material provided in the suction opening.

2. An apparatus as defined in claim 1, wherein the absorbent material is packed in the groove.

3. An apparatus as defined in claim 1, wherein the groove diverges toward its bottom.

4. An apparatus as defined in claim 1, wherein the suction opening is formed as a plurality of pores arranged crosswise of the drum surface.

5. An apparatus as defined in claim 1, wherein the developer collecting means includes an absorbent material embedded in the drum.

6. An apparatus as defined in claim 5, wherein the absorbent material is embedded in a recess produced in the suction opening, the recess having a size sufficient to enable the absorbent material to be wholly embedded in the groove.

7. An apparatus as defined in claim 5, wherein the absorbent material covers the suction opening extending through the drum up to the outside of the drum.

8. An apparatus as defined in claim 1, wherein the drum has a section on which no sheet is placed, the developer collecting means including a groove-shaped recess produced crosswise of the drum in the sheetfree section thereof.

9. An apparatus for producing an electrophotographic print on a photosensitive receptor movable through a plurality of predetermined stations so as to produce an electrostatic latent image on the photosensitive receptor, the apparatus comprising: a rotary drum having a peripheral surface defining an image forming section and a non-image forming section, the photosensitive receptor being placeable on the image forming section of the drum surface; a developing unit having at least one developing station for supplying a developer to the photosensitive receptor on the drum so as to make the electrostatic latent image visible; means for collecting the used developer from the photosensitive receptor, the collecting means being provided axially of the drum in the non-image forming section of the peripheral surface and including a suction opening on the drum surface connected to a sucking means provided externally of the drum, the suction opening being formed as a groove extending crosswise of the drum surface; and a developer absorbent material provided in the suction opening, so as to define a space between the absorbent material and the bottom of the groove.

* * * * *